US006223499B1

(12) United States Patent
Wilkey

(10) Patent No.: US 6,223,499 B1
(45) Date of Patent: May 1, 2001

(54) SLEEVED PACKAGING METHOD

(76) Inventor: Andrew William Wilkey, Boverton Park House, Boverton, Llaïtwit Major (GB), CF61 1UH ( * ) Notice: Subject to any disclaimer, the term of this patent is extended or adjusted under 35 U.S.C. 154(b) by 669 days.

(21) Appl. No.: 08/656,286

(22) PCT Filed: Oct. 25, 1995

(86) PCT No.: PCT/GB95/02509

§ 371 Date: May 28, 1996

§ 102(e) Date: May 28, 1996

(87) PCT Pub. No.: WO96/13432

PCT Pub. Date: May 9, 1996

(30) Foreign Application Priority Data

| | | |
|---|---|---|
| Oct. 27, 1994 | (GB) | 9421646 |
| Dec. 24, 1994 | (GB) | 9426245 |
| Mar. 20, 1995 | (GB) | 9505560 |

(51) Int. Cl.[7] ..... B65B 53/02
(52) U.S. Cl. ..... 53/399; 53/442
(58) Field of Search ..... 53/399, 442, 415, 53/419, 586, 591, 557

(56) References Cited

U.S. PATENT DOCUMENTS

| | | | | |
|---|---|---|---|---|
| 2,885,839 | * | 5/1959 | Weiss | 53/399 |
| 2,895,272 | * | 7/1959 | Krukonis | 53/415 X |
| 3,023,554 | * | 3/1962 | Hlavacek et al. | 53/399 |
| 4,244,471 | * | 1/1981 | Plante | 53/441 X |
| 4,627,218 | * | 12/1986 | Akerstrom et al. | 53/586 X |
| 4,745,014 | * | 5/1988 | Hanaya et al. | 53/442 X |
| 4,956,963 | * | 9/1990 | Johnson | 53/442 |
| 4,984,413 | * | 1/1991 | Cosmo | 53/557 X |
| 4,996,822 | * | 3/1991 | Truppe | 53/592 X |
| 5,430,992 | * | 7/1995 | Olson | 53/399 |
| 5,551,212 | * | 9/1996 | Odenthal | 53/399 X |

FOREIGN PATENT DOCUMENTS

| | | |
|---|---|---|
| 3627376 | 2/1988 | (DE) . |
| 4120480 | 12/1992 | (DE) . |
| 0614610 | 9/1994 | (EP) . |
| 841031 | 7/1960 | (GB) . |

* cited by examiner

*Primary Examiner*—Linda Johnson
(74) *Attorney, Agent, or Firm*—Edwin D Schindler

(57) ABSTRACT

A method is provided in which two or more products are packaged together by wrapping a wrapper of, preferably, a heat-shrinkable plastic sheet material around them. The wrapper is applied so that its opposite edges either overlap and bond together by a contact adhesive, or both bond to one of the products. Optionally, the wrapper is of a heat-shrinkable plastic material, in which case heat may then be applied so as to shrink the wrapper so that the contained products are more firmly held together. It is then an easy matter for the consumer to remove the wrapper, by peeling apart the areas which are held by the contact adhesive. Instead of being positioned side-by-side, the products may be stacked one-on-top-of-the-other, and the wrapper applied around the two products where they meet.

5 Claims, 2 Drawing Sheets

SLEEVED PACKAGING METHOD

The present invention relates to packaging and more particularly to packaging products using sleeves of plastics material.

Often consumer products are marketed in a pack consisting of a pair of packaged products held together by a heat-shrunk sleeve: the sleeve is preformed from a sheet or strip of typically transparent film with opposite edges bonded together, and the sleeve is slipped by hand over the pair of products, after which heat is applied to shrink the sleeve so that the products become firmly embraced by the sleeve. Typically products which are marketed in this manner include, but are not limited to, cosmetic products and hair-care products.

With products packaged as described above, it is often a difficult task for the consumer to remove the sleeve in order to separate the products for use.

We have now devised a method of packaging two or more products together, which enables the products to be separated easily by the consumer.

In accordance with this invention, there is provided a method of packaging two or more products together, the method comprising the steps of providing a wrapper of plastics sheet material with contact adhesive applied to one or more surface areas of the wrapper, the plastic sheet material optionally being heat shrinkable, then wrapping the wrapper about the products which are to be packed together so that opposite edges of the wrapper either overlap and bond together via the applied contact adhesive, or bond to one of the products, and then optionally applying heat to shrink the wrapper.

Because the wrapper is held in position by contact adhesive only, it is easy for the consumer to remove the wrapper by peeling apart the areas which are held by the contact adhesive.

The two or more products may be positioned side-by-side and the wrapper applied around them. Alternatively, the products may be stacked one upon the other and the wrapper applied around each adjacent pair of products where they meet.

In the case of products positioned side-by-side, preferably the wrapper is of heat shrinkable material and heat is applied to the wrapper, after it has been wrapped around the products, so as to shrink the wrapper and cause it to hold the products together more firmly. In the case of products stacked one on top of the other, I have found that it is not always necessary to heat shrink the wrapper.

For example, a continuous or discontinuous stripe of contact adhesive may be applied to one edge of the wrapper, arranged to bond the two opposite edges of the wrapper together once the latter has been wrapped around the products and overlapped.

In the case of products positioned side-by-side, the wrapper may be arranged that it does not wrap fully around the products: a continuous or discontinuous stripe of contact adhesive is applied to both opposite edges of the wrapper, arranged to bond to one of the products at circumferentially spaced-apart positions once the wrapper has been passed partly around the two (or more) products together.

Preferably areas of the inner surface of the wrapper also have contact adhesive applied to them, so as to bond to the products themselves (or to packaging of those products) when the wrapper is wrapped around them. In this way, the products become more firmly held together and avoid the problem (which has occurred in the past) of the products slipping or separating from each other.

The packaging method of this invention lends itself to automation. Preferably the products to be wrapped are brought together and advanced on a conveyor, whilst a wrapper is cut from a roll of sheet material, advanced to a station at which the contact adhesive is applied to it over the desired areas, and then advanced to and wrapped around the products. Alternatively however, the material of the roll may have adhesive preapplied to it over the desired areas, before it is rolled up. Optionally, after the wrapper has been applied around its products, the wrapped products are advanced to a station at which heat is applied to shrink the wrapper.

Embodiments of this invention will now be described by way of examples only and with reference to the accompanying drawings, in which.

Figure 1:
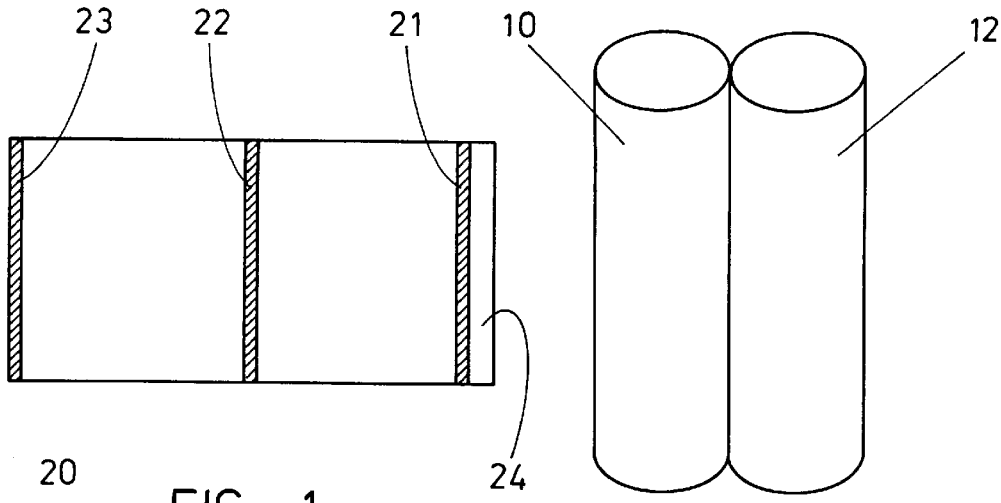
FIG. 1 is a schematic view showing a pair of products to be wrapped side-by-side, and a wrapper to be applied to them.
Figure 2:
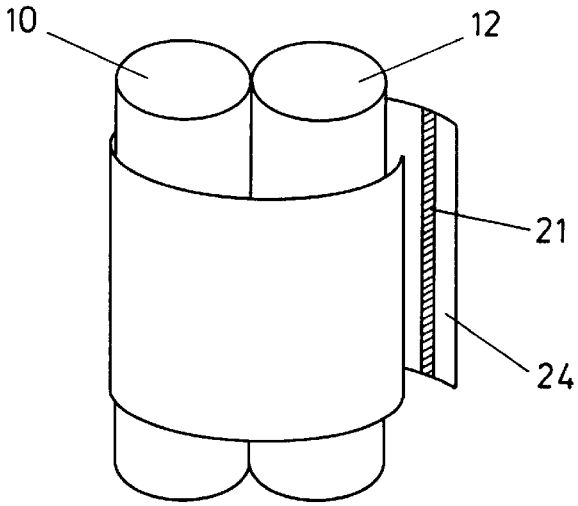
FIG. 2 is a similar view showing the wrapper being applied around the products.
Figure 3:
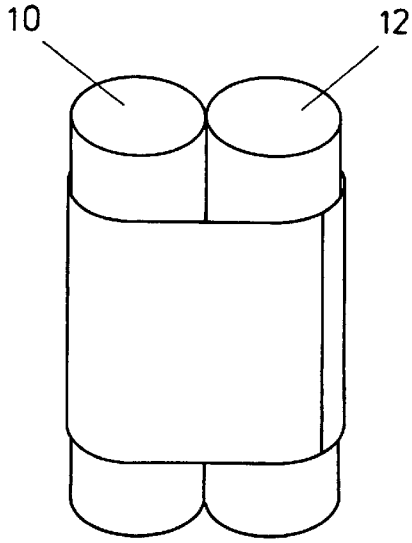
FIG. 3 is a similar view showing the products when wrapped.

Referring to FIG. 1, a pair of products 10,12 are shown which are to be wrapped side-by-side, and then marketed together. In the example shown, the two products comprise cylindrical or tubular containers or dispensers and are shown of the same heights and diameters, but the invention is equally applicable for products of alternative shapes and where the two products are different in size and/or shape from each other. In accordance with this invention, the pair of products 10,12 are brought together in appropriate orientation and advanced along a conveyor. At the same time, a wrapper 20 is cut from a roll of plastics sheet film, and a contact adhesive is applied as a stripe 21 adjacent an edge of the wrapper 20. As shown in FIG. 2, the wrapper 20 is advanced and brought up to the pair of products 10,12 then wrapped around the pair of products until finally (as shown in FIG. 3) the two opposite edges of the wrapper overlap and adhere together by means of the stripe 21 of contact adhesive. Preferably the stripe 21 is inset from the end of the wrapper, to leave a flap 24. Preferably, the wrapper is of heat shrinkable material: in this case, the wrapped pair of products then advances to a station at which heat is applied to shrink the sleeve, resulting in the two products being more firmly held together by the sleeve. The above described procedure is carried out automatically by a machine adapted for the purpose, the details of the machine being omitted from the drawings.

The consumer who purchases the pair of wrapped products is able to unwrap and separate the products easily, by peeling the opposite edges of the wrapper apart along the contact adhesive stripe 21 by means of a small flap 24 which is left after the wrapper 20 has been heat shrunk.

The wrapper 20 may have additional stripes of contact adhesive applied to it, for adhering the inner surface of the wrapper to either or both of the products 10,12. For example a stripe 22 of contact adhesive may be applied down a central position of the wrapper, so as to contact the product 10. A further stripe 23 of contact adhesive may be applied adjacent one of the edges of the wrapper, to contact the product 12 at or adjacent the overlap of the two opposite edges of the wrapper. The contact adhesive stripes 22,23 adhere the inner surface of the wrapper to the products 10,12 themselves (or to any external wrapping pre-applied to these products), so that the pair of products become firmly held together in the final package. However, the consumer can still peel the wrapper easily from the products.

As shown in FIGS. 1 to 3, the wrapper need not extend the full height of the products 10,12 being wrapped, because a wrapper of relatively short height will still hold the products firmly together.

Figure 4:
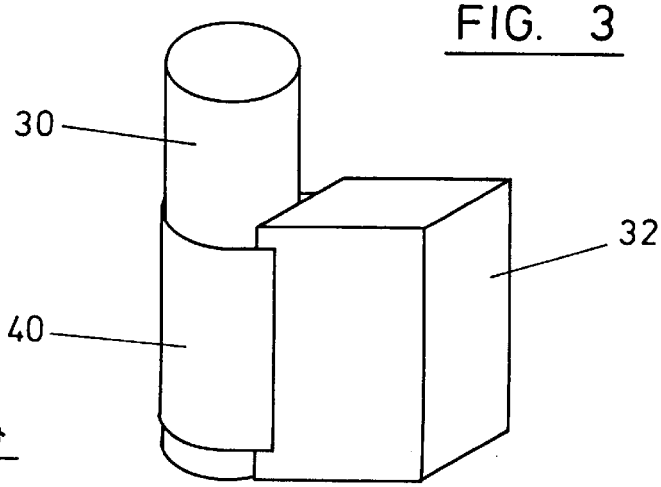
FIG. 4 shows another pair of products wrapped side-by-side by an alternative wrapper.

As shown in FIG. 4, the wrapper need not be wrapped fully around the two products, i.e. its two opposite edges do not have to overlap. In the example shown in FIG. 4, one product 30 comprises a cylindrical container or dispenser, and the other product 32 comprises a cellophane-wrapped carton. A wrapper 40 has been wrapped around the product 30 and its opposite edges (to which contact adhesive stripes have been applied) overlap onto the edges of opposite sides of the carton. The wrapper 40 has preferably been heat-shrunk so that the products are held together more firmly: however because the wrapper 40 comes into contact with the cellophane packaging over a very small area, the cellophane packaging does not become significantly distorted. The consumer can again remove the wrapper 40 easily by peeling its edges from the carton 32.

Instead of (or in addition to) being provided with continuous or discontinuous vertical stripes of contact adhesive, the wrappers may be provided with horizontally-extending stripes, again which may be continuous or discontinuous.

Figure 5:
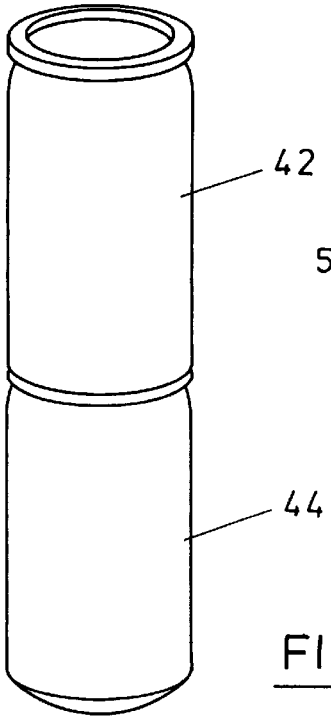
FIG. 5 is a schematic view showing a pair of stacked products to be wrapped.
Figure 6:
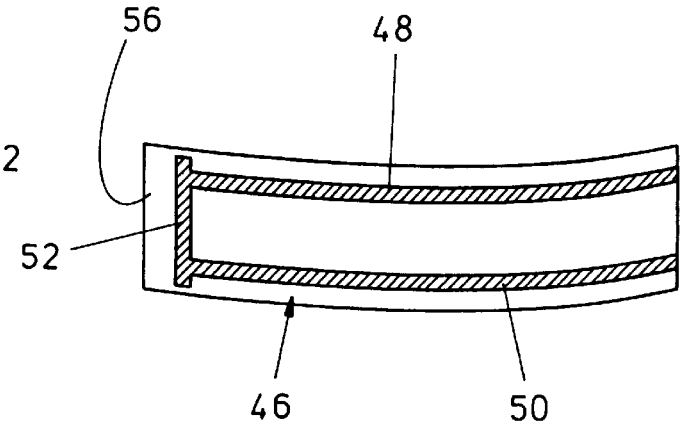
FIG. 6 shows a wrapper prepared for applying around the pair of products shown in FIG. 5.

FIG. 5 illustrates a pair of products 42,44 which are stacked one on top of the other, and are to be wrapped and then marketed together. In the example shown, the two products comprise cylindrical or tubular containers and are shown of the same heights and diameters, however the invention is equally applicable for products of alternative shapes and where the two products are different in size and/or shape from each other. In order that the products, arranged as in FIG. 5, may be joined according to the invention, one of the products 42 is placed on top of the other product 44 and the two products 42,44 are advanced along a conveyor. At the same time, a wrapper 46 (FIG. 6) is cut from a roll of plastics sheet film, and a contact adhesive is applied as a stripe 52 across the wrapper adjacent one of its ends. The wrapper 46 is advanced across the conveyor so that the pair of products 42,44 engage the wrapper at its centre, and then the two ends of the wrapper are wrapped around the pair of products (FIG. 7) until finally (as shown in FIG. 8) the two opposite ends of the wrapper overlap and adhere together by means of the stripe 52 of contact adhesive. Preferably the stripe 52 is inset from the end of the wrapper, to leave a flap 56. Optionally the wrapper is of heat shrinkable material, and the wrapped pair of products then advances to a station at which heat is applied to shrink the sleeve, resulting in the two products being more firmly held together by the sleeve. Lengthwise contact adhesive stripes 48,50 are preferably provided to adhere the inner surface of the wrapper to the products 42,44 themselves (or to any external wrapping pre-applied to these products), so that the pair of products become firmly held together in the final package. However, the consumer can still peel the wrapper easily from the products. The above described procedure is carried out automatically by a machine adapted for the purpose, the details of the machine being omitted from the drawings.

The consumer who purchases such a pair of wrapped products is able to unwrap and separate the products easily, by peeling the opposite edges of the wrapper apart along the contact adhesive stripe 52 by means of a small flap 56 which is left after the wrapper 46 has been heat shrunk.

Figure 7:
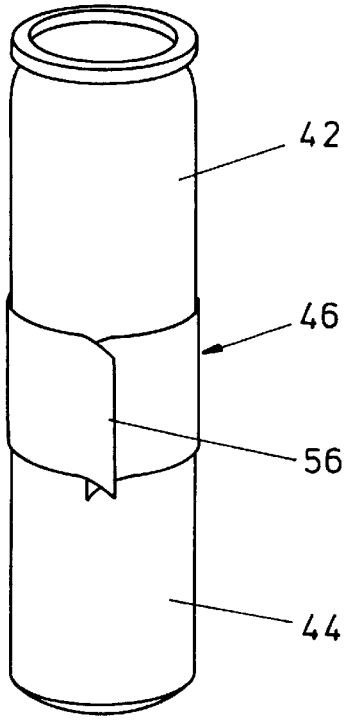
FIG. 7 is a view showing the wrapper being applied around the pair of products of FIG. 5.
Figure 8:
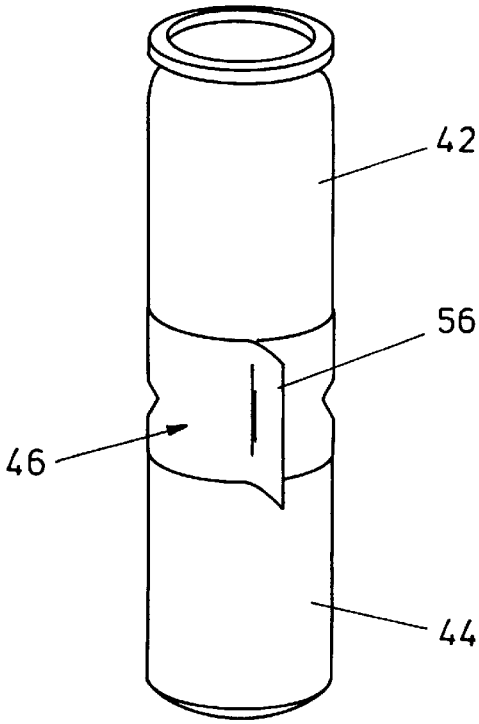
FIG. 8 is a similar view showing the products of FIG. 5 when wrapped.

As shown in FIGS. 7 and 8, the wrapper extends only for a small proportion of the full height of the products 42,44 being wrapped, but still holds the products firmly together.

Instead of (or in addition to) being provided with continuous or discontinuous horizontal stripes 48,50 of contact adhesive, the wrappers may be provided with vertically-extending stripes at different positions along its length: these stripes again may be continuous or discontinuous.

In a modification to the products and procedures as described above, the wrappers may be preformed, complete with the required areas of contact adhesive. For example, the wrappers may be carried on a roll of backing paper, to which they are adhered by means of the areas of contact adhesive, then peeled from this backing paper and applied around products to be packaged, as described above.

It will be appreciated that the wrappers may be pre-printed if desired. Also, the wrappers may be preformed with cut-outs or cut to predetermined shapes if desired.

What is claimed is:

1. A method for packaging at least two products together side-by-side, said method comprising the steps of:

providing at least two products intended to be packaged together side-by-side, said products having opposite top and bottom ends and peripheral side surfaces extending between their respective ends;

positioning said products side-by-side;

providing a wrapper of plastic sheet material, said wrapper having opposite end edges and having contact adhesive applied to a discrete surface area adjacent at least one said end edges thereof; and, wrapping said wrapper about said products for overlapping respective portions only of said side surfaces intermediate said ends of said products, and with said opposite end edges of said wrapper being overlapped and bonded together via said contact adhesive, or with both said opposite end edges of said wrapper bonded to one of said products via said contact adhesive, so that the bonded end edge, or edges, of said wrapper is able to be peeled off for separating said products.

2. The method for packaging at least two products together side-by-side according to claim 1, wherein said wrapper is heat-shrinkable, and said method further comprising the step of applying heat for shrinking said wrapper after said wrapper has been applied around said products.

3. The method for packaging at least two products together side-by-side according to claim 1, wherein said contact adhesive is further applied to, at least, one discrete area of said wrapper intermediate its said opposite end edges, which bonds to said peripheral side surface of at least one of said products around which said wrapper is wrapped.

4. The method for packaging at least two products together side-by-side according to claim 1, further comprising the step of cutting a roll of plastic sheet material to obtain said wrapper and then wrapping said wrapper around said products.

5. The method for packaging at least two products together side-by-side according to claim 1, wherein said wrapper comprises a preformed wrapper and said method further comprises the step of peeling said wrapper from a roll of back paper, which carries a plurality of said wrapper, and then wrapping said wrapper around said products.

* * * * *